US009458802B2

(12) United States Patent
Dudar et al.

(10) Patent No.: US 9,458,802 B2
(45) Date of Patent: Oct. 4, 2016

(54) METHODS AND SYSTEMS FOR PURGING VEHICLE FUEL VAPORS

(71) Applicant: Ford Global Technologies, LLC, Dearborn, MI (US)

(72) Inventors: Aed M. Dudar, Canton, MI (US); Russell Randall Pearce, Ann Arbor, MI (US); Dennis Seung-Man Yang, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 302 days.

(21) Appl. No.: 14/192,336

(22) Filed: Feb. 27, 2014

(65) Prior Publication Data

US 2015/0240756 A1 Aug. 27, 2015

(51) Int. Cl.
*F02M 25/08* (2006.01)

(52) U.S. Cl.
CPC .. *F02M 25/0854* (2013.01); *F02M 2025/0881* (2013.01)

(58) Field of Classification Search
CPC ..... F02M 25/08; F02M 25/0854; F02M 25/0881; F02M 31/125; B01D 53/04; B01D 53/02
See application file for complete search history.

(56) References Cited

U.S. PATENT DOCUMENTS

| | | | | |
|---|---|---|---|---|
| 4,721,846 | A | 1/1988 | Lupoli et al. | |
| 6,689,196 | B2 | 2/2004 | Amano et al. | |
| 6,701,902 | B2 | 3/2004 | Koyama et al. | |
| 7,347,191 | B2 * | 3/2008 | Atwood | B60K 15/035 123/516 |
| 9,145,051 | B2 * | 9/2015 | Dudar | B60K 15/03 |

FOREIGN PATENT DOCUMENTS

| | | | |
|---|---|---|---|
| WO | 2009042354 | A1 | 4/2009 |
| WO | 2009080127 | A1 | 7/2009 |

OTHER PUBLICATIONS

Anonymous, "Method for Purging Evap System's Carbon Canisters at High Altitudes and WOT Operations," IPCOM No. 000234170, Published Jan. 15, 2014, 2 pages.
Anonymous, "Method of Controlling Canister Temperature Using PIEZO-Electric Material to Improve Emissions in HEV," IPCOM No. 000234770, Published Feb. 3, 2014, 2 pages.
Anonymous, "Electric Grid Utilization for Controlling Canister Temperature to Improve Purge Efficiency in PHEV'S," IPCOM No. 000234775, Published Feb. 4, 2014, 2 pages.

* cited by examiner

*Primary Examiner* — Hieu T Vo
(74) *Attorney, Agent, or Firm* — James Dottavio; Alleman Hall McCoy Russell & Tuttle LLP

(57) ABSTRACT

Systems and methods for improving fuel vapor purging for a vehicle are presented. In one example, a fuel vapor storage canister vent valve is housed in a fuel vapor storage canister for the purposes of heating contents of the fuel vapor storage canister and venting the fuel vapor storage canister to atmosphere.

19 Claims, 4 Drawing Sheets

METHODS AND SYSTEMS FOR PURGING VEHICLE FUEL VAPORS

FIELD

The present description relates to a system and methods for improving purging of fuel vapors from a vehicle. The systems and methods may enhance the amount of fuel vapors being purged while not increasing vehicle cost.

BACKGROUND AND SUMMARY

Fuel vapors may form in a vehicle's fuel tank when the vehicle is being operated or while the vehicle is parked. Fuel vapors may form in the fuel tank due to an increase in fuel tank temperature. Further, fuel vapors may form due to agitation of fuel in the fuel tank. The fuel vapors may increase pressure in the fuel tank to a level that is higher than desired if the fuel vapors are not allowed to escape from the fuel tank. However, releasing fuel vapors to the atmosphere may not be desirable since releasing the fuel vapors to atmosphere may increase vehicle emissions and decrease vehicle fuel economy. Therefore, fuel vapors may be captured in a carbon filled canister until a time when the fuel vapors may be directed to an engine where they may be combusted to provide torque to the vehicle. However, it may be possible for small amounts of fuel vapors to escape from a fuel vapor storage canister when a vehicle is parked or during other conditions.

The inventors herein have recognized the above-mentioned disadvantages and have developed a method for purging fuel vapors stored in a fuel vapor storage canister, comprising: heating contents of a fuel vapor storage canister via supplying current to a canister vent valve positioned within the fuel vapor storage canister.

By heating contents of a fuel vapor storage canister, it may be possible to provide the technical result of liberating additional fuel vapors from the fuel vapor storage canister so that fewer fuel vapors may be unintentionally released to atmosphere. In particular, heating a fuel vapor storage canister may increase the amount of fuel vapors released from a fuel vapor storage canister during fuel system fuel vapor purging. Further, since the fuel vapor storage canister may be heated via a canister vent valve, the fuel vapor storage canister may be heated without adding components to the fuel system.

The present description may provide several advantages. Specifically, the approach may reduce an amount of fuel vapors that reach the atmosphere. Additionally, the approach may improve increase vehicle fuel economy. Further, the approach may reduce vehicle emissions without increasing vehicle cost.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example of an embodiment, referred to herein as the Detailed Description, when taken alone or with reference to the drawings, where.

DETAILED DESCRIPTION

Figure 1:
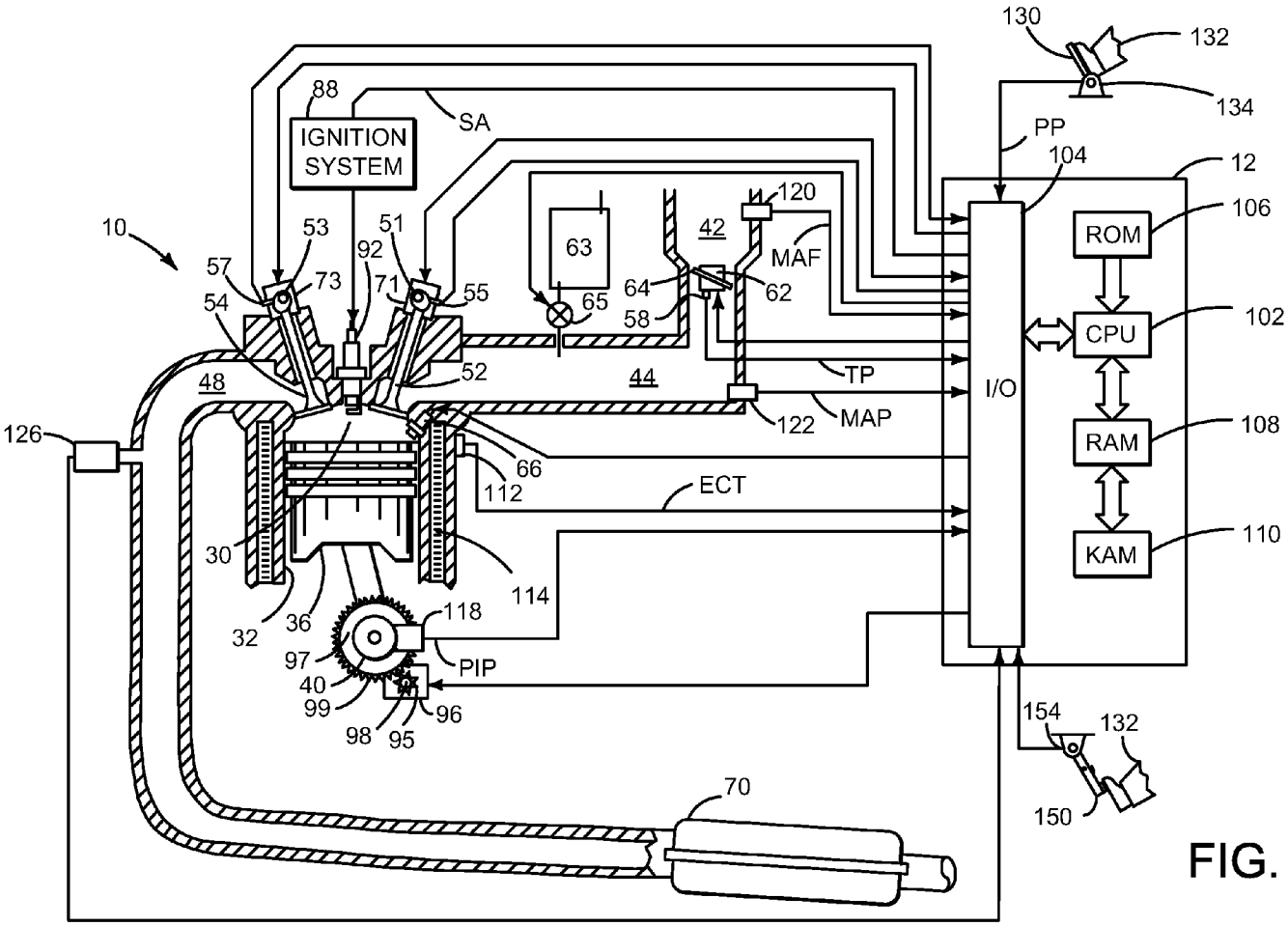
FIG. 1 is a schematic diagram of an engine.
Figure 2:
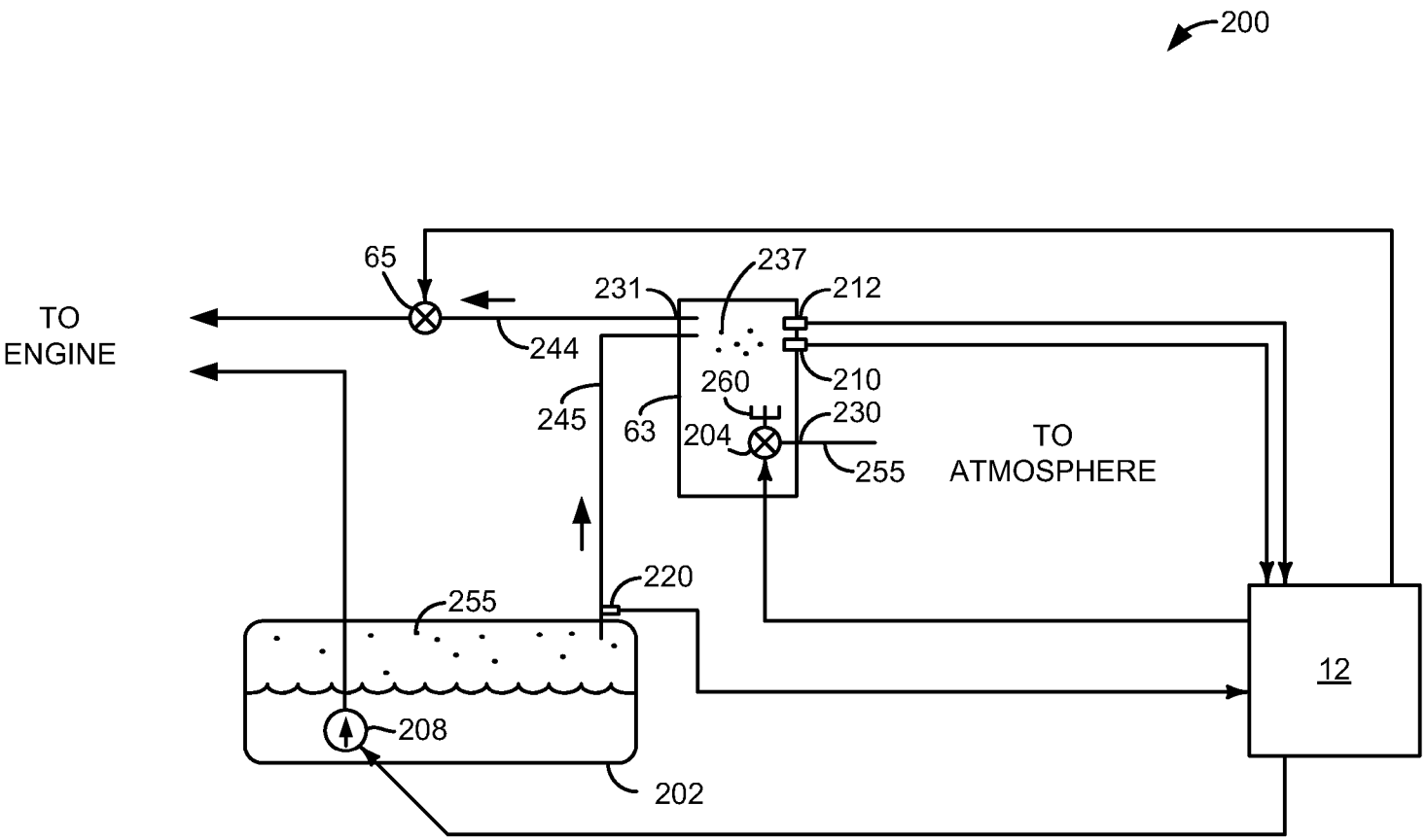
FIG. 2 shows an example fuel vapor storage system.
Figure 3:
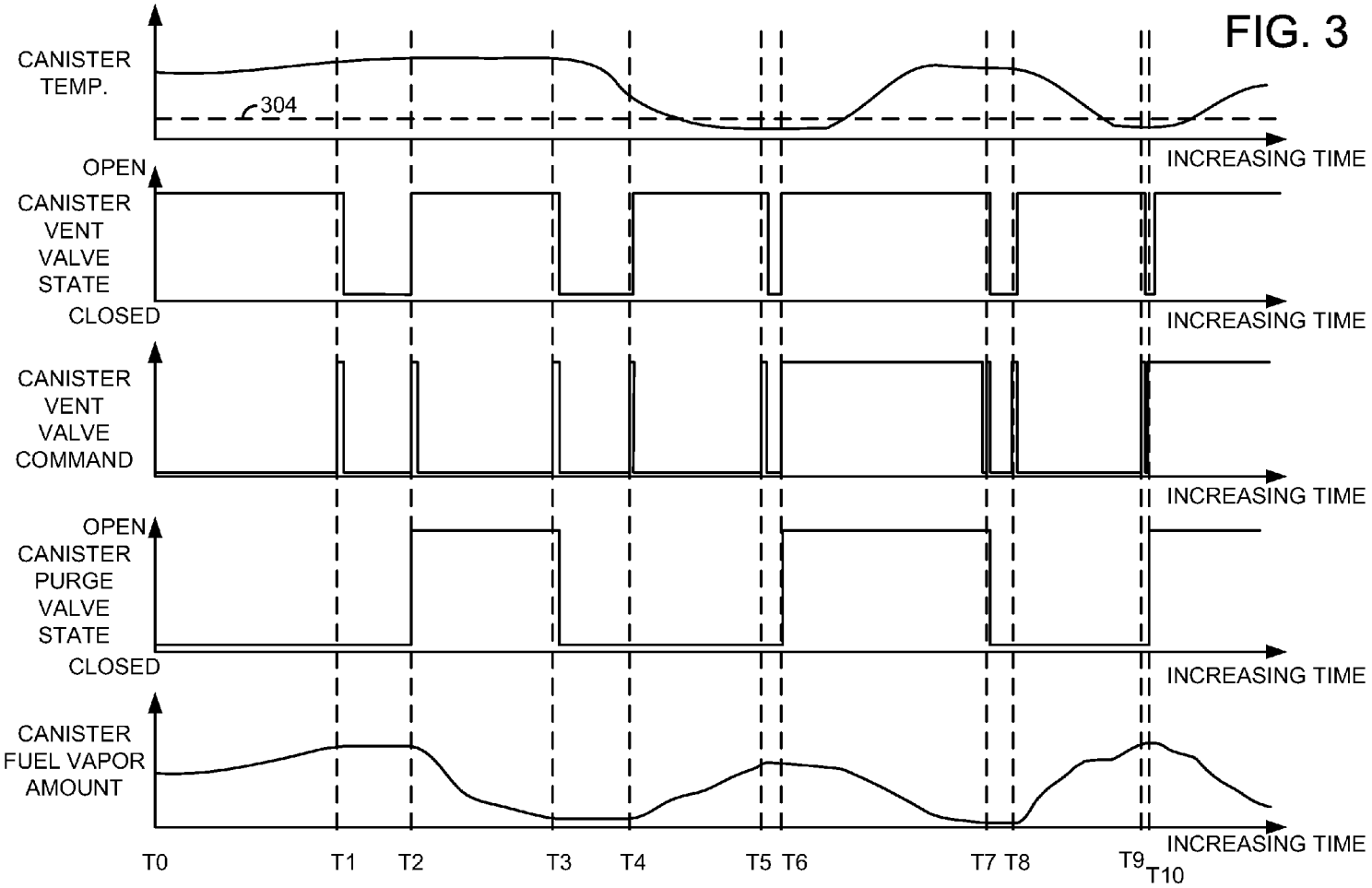
FIG. 3 shows an example simulated fuel vapor storage system operating sequence.

The present description is related to storing and purging fuel vapors of a vehicle. The vehicle may include an engine and fuel vapor storage system as is shown in FIG. 1. FIG. 2 shows a more detailed view of the fuel vapor storage system shown in FIG. 1. The fuel vapor storage system may temporarily store fuel vapors from a fuel tank or other sources. The fuel vapors may be selectively released to an engine for combusting with air. One example, operating sequence is shown in FIG. 3. The engine of FIG. 1 and the fuel vapor storage system of FIG. 2 may be operated according to the method of FIG. 4 to provide the sequence shown in FIG. 3.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40.

Flywheel 97 and ring gear 99 are coupled to crankshaft 40. Starter 96 includes pinion shaft 98 and pinion gear 95. Pinion shaft 98 may selectively advance pinion gear 95 to engage ring gear 99. Starter 96 may be directly mounted to the front of the engine or the rear of the engine. In some examples, starter 96 may selectively supply torque to crankshaft 40 via a belt or chain. In one example, starter 96 is in a base state when not engaged to the engine crankshaft. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. The position of intake cam 51 may be determined by intake cam sensor 55. The position of exhaust cam 53 may be determined by exhaust cam sensor 57. Intake cam 51 and exhaust cam 53 may be moved relative to crankshaft 40 via valve adjusting mechanisms 71 and 73. Valve adjusting mechanisms 71 and 73 may also deactivate intake and/or exhaust valves in closed positions so that intake valve 52 and exhaust valve 54 remain closed during a cylinder cycle.

Fuel injector 66 is shown positioned to inject fuel directly into cylinder 30, which is known to those skilled in the art as direct injection. Alternatively, fuel may be injected to an intake port, which is known to those skilled in the art as port injection. Fuel injector 66 delivers liquid fuel in proportion to the pulse width of signal from controller 12. Fuel is delivered to fuel injector 66 by a fuel system (not shown) including a fuel tank, fuel pump, and fuel rail (not shown). In one example, a high pressure, dual stage, fuel system may be used to generate higher fuel pressures. In addition, intake manifold 44 is shown communicating with optional electronic throttle 62 which adjusts a position of throttle plate 64 to control air flow from air intake 42 to intake manifold 44. In some examples, throttle 62 and throttle plate 64 may be positioned between intake valve 52 and intake manifold 44 such that throttle 62 is a port throttle.

Fuel vapors from a fuel tank (not shown) may be stored in fuel vapor storage canister 63. Fuel vapors may be drawn into intake manifold 44 when intake manifold pressure is lower than atmospheric pressure and when canister purge valve 65 is in an open state.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106 (e.g., non-transitory memory), random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing force applied by driver 132; a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; brake pedal position from brake pedal position sensor 154 when driver 132 applies brake pedal 150; and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

Referring now to FIG. 2, a schematic view of an example fuel vapor storage system is shown. The fuel vapor storage system of FIG. 2 may be included with the engine of FIG. 1, and it may be operated according to the method of FIG. 4 to provide the operating sequence shown in FIG. 3.

Fuel vapor storage system 200 includes fuel vapor storage canister 63, fuel tank 202, and fuel vapor storage canister purge valve 65. Fuel vapor storage canister 63 houses (e.g., contains within its bounds) fuel vapor storage canister vent valve 204. In one example, fuel storage canister vent valve 204 is a solenoid valve. In other examples, fuel vapor storage canister vent valve 204 is a latching valve that opens and/or closes when a voltage or current is applied to the valve for a predetermined amount of time (e.g., 100 ms). The canister vent valve 204 stays in the position it is commanded after the voltage and/or current stops being supplied to the canister vent valve. For example, if the canister vent valve is supplied twelve volts for 100 ms, the canister vent valve moves from an open state to a closed state. If the same canister vent valve is subsequently supplied twelve volts for 100 ms, the canister vent valve moves from the closed state to the open state. In some examples, canister vent valve 204 may include two coils while in other examples it may include only one coil. Canister vent valve 204 is positioned between canister vent port 230 and canister purge port 231. Canister vent valve 204 is in fluidic communication with canister vent 255. Temperature and pressure within fuel vapor storage canister 63 may be sensed via temperature sensor 212 and pressure sensor 210. Fuel vapors may be stored in carbon media 237, and heat may be transferred from canister vent valve 204 to fuel vapor storage canister and carbon media 237 via heat sink 260.

Fuel vapor storage canister 63 is in fluidic communication with fuel tank 202 and fuel vapor storage canister purge valve 65 via respective conduits 244 and 245. Fuel vapors may be drawn into engine 10 via conduit 244. Fuel tank 202 also includes a fuel pump 208 for supplying fuel to engine 10. Controller 12 operates fuel vapor storage canister purge valve 65, fuel pump 208, and fuel vapor storage canister vent valve 204. Controller also receives fuel tank pressure from sensor 220, fuel vapor storage canister temperature from sensor 212, and fuel vapor storage canister pressure from pressure sensor 210. Additionally, a hydrocarbon concentration sensor may be positioned along conduit 244 for determining fuel flow to the engine.

Thus, the system of FIGS. 1 and 2 provides a system for purging fuel vapors, comprising: a fuel tank; an engine intake manifold; and a fuel vapor storage canister, the fuel vapor storage canister in fluidic communication with the fuel tank and the engine intake manifold, the fuel vapor storage canister housing a fuel vapor storage canister vent valve. The system further comprises a controller, the controller including instructions stored in non-transitory memory for selectively supplying current to the fuel vapor storage canister vent valve in response to a temperature of the fuel vapor storage canister. The system further comprises additional instructions for opening the canister vent valve during purging of fuel vapors from the fuel vapor storage canister.

In some examples, the system further comprises a fuel vapor storage canister purge valve and instructions for opening the fuel vapor storage canister purge valve. The system further comprises additional instructions for supplying a varying current to the fuel vapor storage canister vent valve in response to a temperature of the fuel vapor storage canister. The system further comprises additional instructions for maintaining current flow to the fuel vapor storage canister vent valve while the fuel vapor storage canister vent valve is opened in response to a temperature of the fuel vapor storage canister.

Referring now to FIG. 3, an example operating sequence for a fuel vapor storage system is shown. The sequence of FIG. 3 may be provided when the system of FIGS. 1 and 2 is operated according to the method of FIG. 4. Vertical markers T0-T10 represent times of interest during the operating sequence.

The first plot from the top of FIG. 3 is a plot of fuel vapor storage canister temperature versus time. The Y axis represents fuel vapor storage canister temperature and temperature increases in the direction of the Y axis arrow. The X axis represents time and time increases in the direction of the X axis arrow. Horizontal line 302 represents a threshold low fuel vapor storage canister temperature. Temperatures below horizontal line 302 are less than a threshold temperature representing low fuel vapor storage canister temperature.

The second plot from the top of FIG. 3 is a plot of vapor storage canister vent valve state versus time. The Y axis represents fuel vapor storage canister vent valve state. The fuel vapor storage canister vent valve state is open when the trace is at a higher level and closed when the trace is at a lower level near the X axis. The X axis represents time and time increases in the direction of the X axis arrow.

The third plot from the top of FIG. 3 is a plot of fuel vapor storage canister vent valve command versus time. The Y axis represents fuel vapor storage canister vent valve command and the fuel vapor storage canister vent valve is commanding the canister vent valve open or closed when the canister vent valve command is at a higher level. The fuel vapor storage canister vent valve command is not asserted when the trace is at a lower level near the X axis. The X axis represents time and time increases in the direction of the X axis arrow.

The fourth plot from the top of FIG. 3 is a plot of vapor storage canister purge valve state versus time. The Y axis represents fuel vapor storage canister purge valve state. The fuel vapor storage canister purge valve state is open when the trace is at a higher level and closed when the trace is at a lower level near the X axis. The X axis represents time and time increases in the direction of the X axis arrow.

The fifth plot from the top of FIG. 3 is a plot of fuel vapor storage canister stored fuel vapor amount versus time. The Y axis represents fuel vapor storage canister stored fuel vapor amount and stored fuel vapor amount increases in the direction of the Y axis arrow. The X axis represents time and time increases in the direction of the X axis arrow.

At time T0, the fuel vapor storage canister temperature is at a middle level and greater than a low temperature threshold 302. The canister vent valve is open and the canister vent valve is not asserted. In this example, the canister vent valve changes state from open to closed or from closed to open in response to a 100 ms voltage being applied to the fuel vapor storage canister vent valve. The fuel vapor storage vent valve stays latched in the new state after a voltage is applied to the vent valve. However, if the voltage remains applied, the vent valve remains in the new state and the electrical energy supplied to the fuel vapor storage vent valve is converted into heat that is transferred to the inside of the fuel vapor storage canister. In other examples, the fuel vapor storage canister vent valve only remains open or closed while a voltage is applied to the fuel vapor storage canister vent valve. The fuel vapor vent valve command is at a lower level and the fuel vapor vent valve is not being commanded to change state. The fuel vapor storage canister purge valve is closed as indicated by the purge valve trace being at a lower level. Finally, the fuel vapor storage canister stored fuel vapor amount is at a middle level. Such conditions are indicative of a condition when fuel vapors are flowing from a fuel tank to the fuel vapor storage canister without being simultaneously purged to the engine.

Between time T0 and time T1, the fuel vapor canister stored fuel vapor amount increases as fuel vapors enter the fuel vapor storage canister from the fuel tank. The canister vent valve remains open and the canister purge valve remains closed. However, in some examples, the canister purge valve may open to purge fuel vapors directly from the fuel tank to the engine.

At time T1, the fuel vapor storage canister vent valve is commanded closed as indicated by the canister vent valve command transitioning from a lower level to a higher level and back to the lower level. The fuel vapor storage canister vent valve may be commanded closed in response to fuel tank pressure being reduced to less than a threshold pressure. The fuel vapor storage canister vent valve does not heat the fuel vapor canister by an amount that increases fuel vapor release from the fuel vapor storage canister when voltage is applied to the canister vent valve in this way. The fuel vapor storage canister purge valve remains closed and the fuel vapor canister stored fuel vapor amount stops increasing. The fuel vapor storage canister remains at a higher level temperature.

At time T2, the fuel vapor storage canister vent valve is commanded open and the fuel vapor storage canister purge valve is opened in response to the fuel vapor canister stored fuel amount being at a higher level and engine operating conditions being conducive to purging the fuel vapor canister. The fuel vapor canister stored fuel amount begins to decrease in response to the fuel vapor storage canister purge valve being open. The fuel vapor canister temperature is at a level above threshold 304. Therefore, the fuel vapor storage canister is not heated via the fuel vapor storage canister vent valve.

At time T3, the fuel vapor storage canister vent valve is commanded closed and the fuel vapor storage canister purge valve is closed in response to the fuel vapor canister stored fuel amount being at a low level. The fuel vapor storage canister vent valve is supplied voltage for a short duration so that contents of the fuel vapor canister are not heated by the fuel vapor storage canister vent valve and so that the fuel vapor storage canister vent valve is closed.

Between time T3 and time T4, the fuel vapor canister temperature begins to decrease. The fuel vapor temperature may decrease in response to a reduction in ambient temperature. Further, the fuel vapor canister stored fuel vapor amount remains at a constant level.

At time T4, the fuel vapor storage canister vent valve is commanded open in response to fuel tank pressure. The fuel tank pressure may increase in response to the fuel tank being filled or other conditions. The fuel vapor storage canister vent valve is supplied voltage for a short period of time to open the fuel vapor canister without heating contents of the fuel vapor canister since the fuel vapor canister temperature is greater than threshold 304. By opening the fuel vapor storage canister vent valve, fuel vapors may migrate from the fuel tank to the fuel vapor canister where fuel vapors are stored within carbon media before air carrying the fuel vapors is allowed to escape from the fuel vapor canister via the fuel vapor storage canister vent valve. The fuel vapor canister temperature continues to be reduced and the fuel vapor storage canister purge valve remains in a closed state. The fuel vapor canister stored fuel vapor amount begins to increase after the fuel vapor storage canister vent valve is opened.

At time T5, the fuel vapor storage canister vent valve is commanded closed in response to a low fuel tank pressure. The fuel vapor storage canister vent valve closes and the fuel vapor canister fuel vapor amount stops increasing. The fuel vapor canister temperature is at a lower level.

At time T6, the fuel vapor storage canister vent valve is commanded open, and instead of applying voltage for a short time simply to open the canister vent valve, voltage remains applied to the fuel vapor storage canister vent valve to heat the fuel vapor canister via electrical energy. The fuel vapor storage canister vent valve is commanded open in response to the fuel vapor canister stored fuel vapor amount being at a higher level. The voltage is applied to the fuel vapor storage canister vent valve to heat contents of the fuel vapor storage canister in response to fuel vapor canister temperature and the fuel vapor canister stored fuel vapor amount. The fuel vapor canister temperature begins to increase after the voltage is applied to the fuel vapor storage canister vent valve for a time. The fuel vapor storage canister purge valve is also opened in response to the fuel vapor canister stored fuel vapor amount. The fuel vapor canister stored fuel amount begins to decrease after the purge valve is opened. The voltage applied to fuel vapor storage canister vent valve is reduced after the fuel vapor canister temperature reaches a desired temperature before time T7.

At time T7, the fuel vapor storage canister vent valve is commanded closed by applying voltage for a short duration to the fuel vapor storage canister vent valve in response to the low fuel vapor canister stored fuel vapor amount. The fuel vapor storage canister purge valve is also closed in response to the low fuel vapor canister stored fuel vapor amount.

At time T8, the fuel vapor storage canister vent valve is commanded open in response to fuel tank pressure. The fuel vapor storage canister vent valve is supplied voltage for a short period of time to open the fuel vapor canister without heating contents of the fuel vapor canister since the fuel vapor canister temperature is greater than threshold 304. The fuel vapor canister temperature begins to be reduced and the fuel vapor storage canister purge valve remains in a closed state. The fuel vapor canister stored fuel vapor amount begins to increase after the fuel vapor storage canister vent valve is opened since fuel vapors are allowed to flow from the fuel tank to the fuel vapor storage canister.

At time T9, the fuel vapor storage canister vent valve is commanded closed in response to a low fuel tank pressure. The fuel vapor storage canister vent valve closes and the fuel vapor canister fuel vapor amount stops increasing. The fuel vapor canister temperature is at a lower level.

At time T10, the fuel vapor storage canister vent valve is commanded open and the voltage applied to the fuel vapor storage canister vent valve remains at a higher level so that contents of the fuel vapor canister may be heated. The fuel vapor storage canister vent valve is commanded open in response to the fuel vapor canister stored fuel vapor amount being at a higher level. The fuel vapor canister temperature begins to increase after the voltage is applied to the fuel vapor storage canister vent valve for a time. The fuel vapor storage canister purge valve is also opened in response to the fuel vapor canister stored fuel vapor amount. The fuel vapor canister stored fuel amount begins to decrease after the purge valve is opened.

Thus, a fuel vapor storage canister vent valve may be operated so as to increase a temperature of the fuel vapor canister, or such that fuel vapor canister contents are not heated. By heating contents of the fuel vapor canister, it may be possible to increase the amount of fuel vapors purged from the canister so that the possibility of releasing fuel vapors to the atmosphere is reduced.

Figure 4:
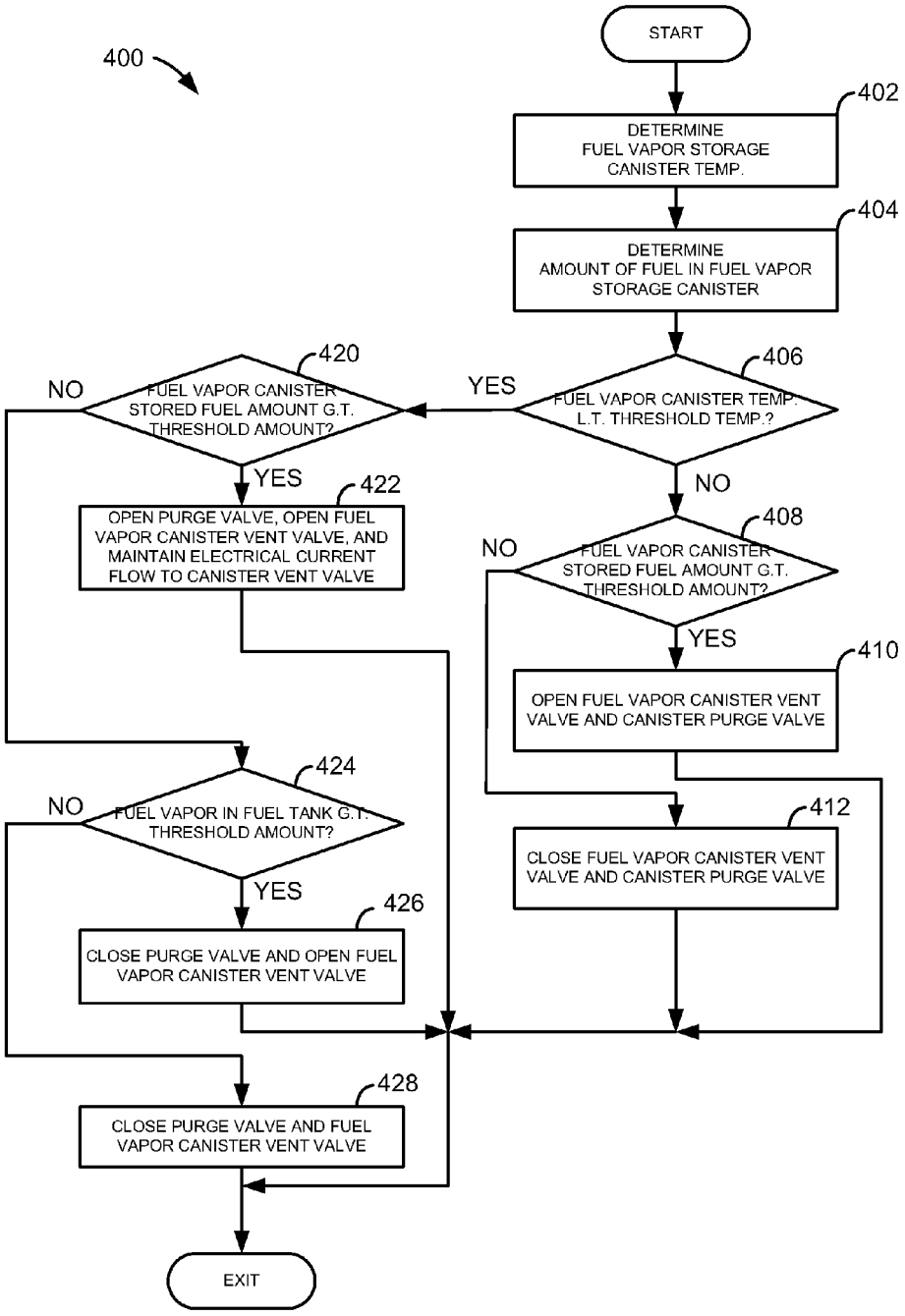
FIG. 4 shows an example method for operating a fuel vapor storage system.

Referring now to FIG. 4, a method for operating a fuel vapor storage system is shown. The method of FIG. 4 may be included in the system of FIGS. 1 and 2. Further, the method of FIG. 4 may provide the operating sequence shown in FIG. 3. The method of FIG. 4 may be included as instructions in non-transitory memory.

At 402, method 400 determines a fuel vapor storage canister temperature. In one example, temperature of carbon media is determined via a temperature sensor. Alternatively, temperature within the fuel vapor storage canister may be inferred from an impedance of a coil of a fuel vapor storage canister vent valve. Method 400 proceeds to 404 after the temperature of the fuel vapor storage canister is determined.

At 404, method 400 determines an amount of fuel vapor stored in a fuel vapor storage canister. In one example, an amount of fuel vapor stored in the fuel vapor storage canister may be based on an estimate of hydrocarbons entering the fuel vapor storage canister. For example, output of a hydrocarbon concentration sensor may be multiplied by a flow rate into the fuel vapor storage canister and integrated to determine a fuel mass stored in the fuel vapor storage canister. In other examples, other known methods to determine the amount of fuel vapor stored in the fuel vapor storage canister may be employed. Method 400 proceeds to 406 after the fuel vapor storage canister stored fuel vapor amount is determined.

At 406, method 400 judges whether or not a fuel vapor storage canister temperature is less than (L.T.) a threshold temperature. In one example, the threshold temperature is a temperature that allows a predetermined amount of hydrocarbons to be liberated from the fuel vapor storage canister in a predetermined amount of time. If method 400 judges that the fuel vapor storage canister temperature is less than the threshold temperature, the answer is yes and method 400 proceeds to 420. Otherwise, the answer is no and method 400 proceeds to 408.

At 420, method 400 judges whether or not a fuel vapor storage canister stored fuel amount is temperature is greater than (G.T.) a threshold amount. In one example, the threshold amount is an amount that represents a predetermined fraction of the fuel vapor storage canister's fuel vapor storage capacity. If method 400 judges that the fuel vapor storage canister stored fuel amount is greater than the threshold amount, the answer is yes and method 400 proceeds to 422. Otherwise, the answer is no and method 400 proceeds to 428.

At 422, method 400 opens the fuel vapor storage canister purge valve, closes the fuel vapor storage canister vent valve, and maintains electrical current flow to the fuel vapor storage canister vent valve. By opening the fuel vapor storage canister purge valve, fuel vapors may be drawn from the fuel tank and through the fuel vapor storage canister purge valve to evacuate fuel vapors from the fuel tank. Further, opening the fuel vapor storage canister vent valve allows air to be drawn from atmosphere, through the fuel vapor storage canister where fuel vapors are liberated, and into the engine intake manifold via the fuel vapor storage canister purge valve. A constant voltage may be supplied to the fuel vapor storage canister vent valve to heat the fuel vapor storage canister via the fuel vapor storage canister vent valve. Alternatively, a time-varying current with a higher frequency than the natural frequency of the canister vent valve may be supplied to the fuel vapor storage canister vent valve to heat the fuel vapor storage canister. By supplying current at a higher frequency than the natural frequency of the fuel vapor storage canister vent valve, eddy currents may be produced to heat the fuel vapor storage canister vent valve and the fuel vapor storage canister. Method 400 proceeds to exit after the fuel vapor storage canister vent valve and purge valves are opened.

At 424, method 400 judges whether or not fuel vapor within the vehicle's fuel tank is greater than a threshold amount. The amount of fuel vapor in the fuel tank may be inferred from fuel tank pressure. If method 400 judges that the fuel vapor amount is greater than a threshold amount, the answer is yes and method 400 proceeds to 426. Otherwise, the answer is no and method 400 proceeds to 428.

At 426, method 400 closes the fuel vapor storage canister purge valve and opens the fuel vapor canister vent valve. By closing the fuel vapor storage canister purge valve and opening the fuel vapor canister vent valve, fuel vapors in the fuel tank may be stored to the fuel vapor canister since pressure in the fuel tank is relieved to near atmospheric pressure when the fuel vapor canister vent valve is opened. Voltage and/or current supplied to the fuel vapor vent valve may be stopped after the fuel vapor canister vent valve is opened so that content of the fuel vapor storage canister is not heated. Method 400 proceeds to exit after the fuel vapor canister vent valve is opened.

At 428, method 400 closes the fuel vapor storage canister purge valve and the fuel vapor canister vent valve. By closing the fuel vapor storage canister purge valve and the fuel vapor canister vent valve, flow of fuel vapors between the fuel tank, engine, and fuel vapor storage canister is stopped. Method 400 proceeds to exit after the fuel vapor canister vent valve is closed.

At 408, method 400 judges whether or not a fuel vapor storage canister stored fuel amount is temperature is greater than (G.T.) a threshold amount. If method 400 judges that the fuel vapor storage canister stored fuel amount is greater than the threshold amount, the answer is yes and method 400 proceeds to 410. Otherwise, the answer is no and method 400 proceeds to 412.

At 410, method 400 opens the fuel vapor storage canister vent valve and the fuel vapor storage canister purge valve. Further, the fuel vapor storage canister vent valve is not used to heat the fuel vapor storage canister. However, in some examples or during some conditions, the voltage/current may be applied to the fuel vapor storage canister vent valve to heat the fuel vapor storage canister even though the amount of fuel vapors stored in the fuel vapor storage canister is low. For example, if the stored amount of fuel vapor is non-zero and the vehicle is in regenerative braking mode or traveling downhill with driver demand torque less than a threshold torque, electrical energy from regenerative braking may be used to heat the fuel vapor canister to liberate any stored fuel vapors. In this way, the vehicle's kinetic energy may be used to heat the fuel vapor storage canister. Method 400 proceeds to exit after the fuel vapor storage canister vent valve and the fuel vapor storage canister purge valve have been opened.

At 412, method 400 closed the fuel vapor storage canister vent valve and the fuel vapor storage canister purge valve. The fuel vapor storage canister vent valve and fuel vapor storage canister purge valve are closed when a small amount of fuel vapor is present in the fuel system. Method 400 proceeds to exit after the fuel vapor storage canister vent valve and fuel vapor storage canister purge valve are closed.

Thus, the method of FIG. 4 selectively applies voltage/current to heat the fuel vapor storage canister. In particular, voltage/current is applied when it is desired to reduce the amount of stored fuel vapors in the system when fuel system temperature is less than is desired. Further, during some conditions, the vehicle's excess kinetic energy may be used to heat the fuel vapor storage canister to reduce electrical consumption and increase vehicle fuel economy.

Thus, the method of FIG. 4 provides for purging fuel vapors stored in a fuel vapor storage canister, comprising: heating contents of a fuel vapor storage canister via supplying an electrical current to a canister vent valve positioned within the fuel vapor storage canister. The method includes where the electrical current is substantially constant. The method includes where the electrical current is varied in time. The method includes where the electrical current is varied at a frequency that is greater than a natural frequency of the canister vent valve. The method also includes where the canister vent valve is positioned between a canister vent port and a canister purge port. The method includes where the electrical current is supplied to the canister vent valve in response to a temperature of the fuel vapor storage canister. The method includes where the electrical current is supplied to the canister vent valve when the canister vent valve is closed.

The method of FIG. 4 also provide for purging fuel vapors stored in a fuel vapor storage canister, comprising: heating contents of a fuel vapor storage canister via supplying an electrical current to a canister vent valve positioned within the fuel vapor storage canister; and purging contents of the fuel vapor storage canister to an engine intake manifold in response to an amount of fuel vapor stored in the fuel vapor storage canister. The method further comprises closing a purge valve and ceasing flow of the electrical current in response to a temperature of the fuel vapor storage canister. The method includes where the electrical current is varied with time. The method further comprises supplying the electrical current in response to a temperature of the fuel vapor storage canister. The method further comprises flowing fuel vapors from a fuel tank to the fuel vapor storage canister. The method further comprises transferring heat from the canister vent valve to the fuel vapor storage canister via a heat sink. The method includes where the canister vent valve is in fluidic communication with a canister vent port.

As will be appreciated by one of ordinary skill in the art, method described in FIG. 4 may represent one or more of any number of processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the objects, features, and advantages described herein, but is provided for ease of illustration and description. Although not explicitly illustrated, one of ordinary skill in the art will recognize that one or more of the illustrated steps or functions may be repeatedly performed depending on the particular strategy being used. Further, the described actions, operations, methods, and/or functions may graphically represent code to be programmed into non-transitory memory of the computer readable storage medium in the engine control system.

This concludes the description. The reading of it by those skilled in the art would bring to mind many alterations and modifications without departing from the spirit and the scope of the description. For example, I3, I4, I5, V6, V8, V10, and V12 engines operating in natural gas, gasoline, diesel, or alternative fuel configurations could use the present description to advantage.

The invention claimed is:

1. A system for purging fuel vapors, comprising:

a fuel tank;

an engine intake manifold;

a fuel vapor storage canister, the fuel vapor storage canister in fluidic communication with the fuel tank and the engine intake manifold, the fuel vapor storage canister housing a fuel vapor storage canister vent valve; and a controller including instructions stored in non-transitory memory for selectively supplying current to the fuel vapor storage canister vent valve in response to a temperature of the fuel vapor storage canister being below a threshold temperature.

2. The system of claim 1, further comprising additional instructions for opening the canister vent valve during purging of fuel vapors from the fuel vapor storage canister.

3. The system of claim 2, further comprising a fuel vapor storage canister purge valve and instructions for opening the fuel vapor storage canister purge valve.

4. The system of claim 1, further comprising additional instructions for supplying a varying current to the fuel vapor storage canister vent valve in response to the temperature of the fuel vapor storage canister.

5. The system of claim 1, further comprising additional instructions for maintaining current flow to the fuel vapor storage canister vent valve while the fuel vapor storage canister vent valve is opened in response to the temperature of the fuel vapor storage canister.

6. A method for purging fuel vapors stored in a fuel vapor storage canister, comprising:

heating contents of the fuel vapor storage canister via supplying an electrical current to a canister vent valve positioned within the fuel vapor storage canister, wherein the fuel vapor storage canister is coupled to a fuel tank, and where the canister vent valve operatively interposes the fuel vapor storage canister and ambient air.

7. The method of claim 6, where the electrical current is substantially constant.

8. The method of claim 6, where the electrical current is varied in time, and wherein the heating occurs during a purge event.

9. The method of claim 8, where the electrical current is varied at a frequency that is greater than a natural frequency of the canister vent valve, and wherein the electrical current is maintained until the end of the purge event.

10. The method of claim 6, where the canister vent valve is positioned between a canister vent port and a canister purge port.

11. The method of claim 6, where the electrical current is supplied to the canister vent valve in response to a temperature of the fuel vapor storage canister being below a threshold.

12. The method of claim 6, where the electrical current is supplied to the canister vent valve when the canister vent valve is closed.

13. A method for purging fuel vapors stored in a fuel vapor storage canister, comprising:

heating contents of the fuel vapor storage canister via supplying an electrical current to a canister vent valve positioned within the fuel vapor storage canister; and purging contents of the fuel vapor storage canister to an engine intake manifold in response to an amount of fuel vapor stored in the fuel vapor storage canister, wherein the supplied electrical current is maintained until the end of the purging.

14. The method of claim 13, further comprising closing a purge valve and ceasing flow of the electrical current in response to a temperature of the fuel vapor storage canister.

15. The method of claim 13, where the electrical current is varied with time.

16. The method of claim 15, further comprising determining a temperature of the fuel vapor storage canister and supplying the electrical current in response to the temperature of the fuel vapor storage canister being below a threshold.

17. The method of claim 13, further comprising flowing fuel vapors from a fuel tank to the fuel vapor storage canister.

18. The method of claim 13, further comprising transferring heat from the canister vent valve to the fuel vapor storage canister via a heat sink.

19. The method of claim 13, where the canister vent valve is in fluidic communication with a canister vent port.

* * * * *